United States Patent [19]

Ando et al.

[11] 4,046,466

[45] Sept. 6, 1977

[54] METHOD AND APPARATUS FOR ELECTROPHOTOGRAPHY

[75] Inventors: Yujiro Ando, Yokohama; Katsunobu Ohara, Kawasaki; Yukimasa Shinohara, Yokohama, all of Japan

[73] Assignee: Canon Kabushiki Kaisha, Tokyo, Japan

[21] Appl. No.: 632,697

[22] Filed: Nov. 17, 1975

[30] Foreign Application Priority Data

Nov. 22, 1974 Japan ..... 49-134923

[51] Int. Cl.[2] ..... G03G 15/00

[52] U.S. Cl. ..... 355/3 R; 96/1 R

[58] Field of Search ..... 355/3 R, 3 CH, 3 SC, 355/16; 96/1 R

[56] References Cited

U.S. PATENT DOCUMENTS

| | | | |
|---|---|---|---|
| 3,615,395 | 10/1971 | Yamaji et al. | 355/3 R X |
| 3,898,085 | 8/1975 | Suzuki et al. | 355/3 R X |
| 3,930,850 | 1/1976 | Matsumoto et al. | 355/3 R X |
| 3,936,177 | 2/1976 | Moriyama et al. | 355/3 R X |
| 3,945,725 | 3/1976 | Moriyama et al. | 355/3 R |

*Primary Examiner*—Fred L. Braun

*Attorney, Agent, or Firm*—Fitzpatrick, Cella, Harper & Scinto

[57] ABSTRACT

An electrophotographic method by the use of a photosensitive screen having a number of tiny openings therein and by modulation of corona ion current, wherein a primary electrostatic latent image is first formed on the screen by application of electrostatic charge in conformity to an original image to be reproduced, thus a secondary electrostatic latent image is formed by modulating corona ion current for a plurality of times by the use of one and the same primary electrostatic latent image, and applying to the screen, alternately with the corona ion modulation, a corona ion current of a polarity capable of eliminating the charge polarity of the modulating corona ion current.

16 Claims, 14 Drawing Figures

METHOD AND APPARATUS FOR ELECTROPHOTOGRAPHY

BACKGROUND OF THE INVENTION

1. Field of the Invention

This invention relates to a method and apparatus for electrophotography utilizing a photosensitive screen having therein a large number of tiny openings. More particularly, the present invention is concerned with a method and apparatus for forming an original image to be produced by modulating ion current over a repeated number of times through one and the same primary electrostatic latent image formed on such photosensitive screen.

2. Description of the Prior Arts

For representative electrophotographic tecniques which have so far been known, there can be exemplified a direct method such as electro-fax method, and an indirect method such as xerographic method.

In the formation of an image by the former method, i.e., direct method, there has been used an image recording member produced by coating a substrate with a photoconductive substance such as, for example, zinc, oxide, etc., and by some other special treatment. On account of this, the image formed on the finished image recording material lacks brightness, hence a problem of insufficient image contrast has always been experienced by those who use such recording member. Furthermore, the recording member thus treated has a defect such that it possesses senses of touch and weight which are somewhat different from those of plain paper for general use.

In the formation of an image by the latter method, i.e., indirect method, the desired image can be can be formed by the use of plain paper as the recording member, hence the image of good contrast can be advantageously obtained. On the other hand, however, the method is not free from any defect in that, when the toner image is to be transferred onto the recording member, it inevitably contacts the surface of the photosensitive body, and, moreover, when the residual toner is to be cleaned, the cleaning device such as brush, elastic body, and so forth vigorously rubs this photosensitive body to possibly impair its surface. Such unfavorable phenomena in the image recording operations would severely curtail service life of the expensive photosensitive body, which would result in inviting increased cost in the image reproduction.

As an expedient to remove various problems which have so far been experienced in the heretofore known electrophotographic technique, there can be exemplified the electrophotographic method as taught in U.S. Pat. No. 3,713,734. In this patented method, a photosensitive screen or lattice structure having therein numerous tiny openings in the form of a network is utilized. With this screen or lattice, an electrostatic latent image is formed on a recording member by modulating ion current through this screen, etc.; after which the electrostatic latent image on this recording member is developed for visual image. That is, in this electrophotographic method, there is no necessity for development and cleaning of the photosensitive screen or lattice which corresponds to the photosensitive body in the conventional apparatus. Therefore, the electrophotographic methods as taught in this patent possesses remarkable advantages as compared with the conventional photosensitive body, such that the photosensitive screen, etc., can be used over a long period of time. Also, of the techniques which modulate the ion current by use of the photosensitive screen or lattice as mentioned above, there is such one that enables the modulation of the ion current to be carried out for a number of repeated times with one and the same primary electrostatic latent image formed on the screen, etc. In case of producing a number of sheets of reproduced images from one and the same original by using such photosensitive screen, i.e., when the so-called "retention copying" is to be performed, the image forming speed can be remarkably improved for the undermentioned reasons.

That is to say, in modulating the ion current after the second cycle of the image reproduction, the time required for forming the primary electrostatic latent image on the screen can be dispensed with. This adds a remarkable effect to the retention copying where, in particular, the process for forming the electrostatic latent image on the screen is very complicated and longer time is necessary for that, or the image forming speed of the primary electrostatic latent image is very slow due to the responding speed to light of the photosensitive screen being slow on account of the characteristic of the photoconductive member used therefor. Generally speaking, however, when the ion current modulation is continuously carried out on the screen for a plurality of times with one and the same primary electrostatic latent image, there is inevitably brought about a large difference in the electric potential between the secondary electrostatic latent image formed on the recording member at the initial stage and that formed at the last stage, as the number of times for the modulation becomes increased. In other words, the latent image at the imitial stage has a high electrostatic contrast and is able to produce images when developed, while the latentimage at the last stage of retention copying has its electrostatic contrastlowered to a certain extent, and, when developed, there arises undesirable results such that the image density is considerably lowered, or the fogging phenomenon takes place in the reproduced image. Also, depending on the kind of screen, there takes place not only the potential difference in the secondary electrostatic latent image beteen the intial and last ones as mentioned above, but also remarkably potential diffeence between the first and second ones, or between the first and second or a few subsequent ones. On account of this, even the retention copying technique which has made it possible to theoretically shorten the image forming time still possesses various actual problems and defects to be solved in respect of nonuniformity in the modulated ion current. Solution of these problems and defects can only lead to practicability in the retention copying.

SUMMARY OF THE INVENTION

In view of the abovementioned various problems and defects inherent in the conventional device and method for the retention copying, it is primary object of the present invention to provide a method and an apparatus for carrying out favorable ion current modulation for a plurality of times through one and the same primary electrostatic latent image by the use of a photosensitive screen or lattice.

It is another object of the present invention to provide a method and an apparatus for securing constant ion flow to reach the secondary electrostatic latent image forming member at the time of modulating the ion current.

It is still another object of the present invention to provide a method and an apparatus for remarkably increasing the number of times for modulating the ion current by one and the same primary electrostatic latent image.

It is other object of the present invention to provide a photosensitive screen capable of modulating the ion current over repeated number of times, as well as a method and an apparatus for image formation by means of such photosensitive screen.

The present invention is so designed that, when a side of the photosensitive screen having a multitude of tiny openings, which faces an ion current source, possesses such characteristic that retains the ion current thus imparted, an ion current containing therein ions of an opposite polarity to that of the modulating ion current is imparted to the ion current source side of the screen during or after the ion current modulation, whn such ion current is to be modulated by the primary electrostatic latent image on the photosensitive screen. As a result, any harmful electric change adhered onto the screen is removed, thereby making it possible to constantly modulate the ion current in a stable state, and to remarkably increase the numbe of times for the ion current modulation.

The foregoing objects and other objects of the present invention as well as its construction, function, and resulting effect thereof will become more apparent from the following detailed description, when read in connection with the accompanying drawing.

BRIEF DESCRIPTION OF THE DRAWING

In the drawing:

FIGS. 7A and 7B denote the flow of ions, wherein FIG. 7A shows an opening of the screen at a region where the positive ions are to be passed, and FIG. 7B shows and opening of the screen at a region where passage of the positive ions is to be hindered;

DESCRIPTION OF THE PREFERRED EMBODIMENT

Figure 1:
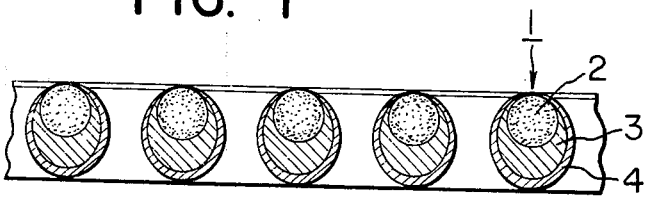
FIG. 1 is an enlarged cross-sectional view of the photosensitive screen for use in the present invention.

As shown in FIG. 1, the photosensitive screen for use in the present invention is basically constructed with an electrically conductive member as a substrate, on which a photoconductive member and a surface insulating member are coated. The screen is also provided therein with a multitude of tiny openings. The electrically conductive portion is present either in part or over the entire surface at one side of the screen. The primary electrostatic latent image is formed on this screen by performing, in combination, both voltage application step such as electric charging, discharging, etc., and irradiation step such as light illumination onto an original image to be reproduced, overall surface irradiation, and so on. Then, ion current emitted from a corona discharger or other ion current generating source to be applied onto the photosensitive screen is modulated by the primary electrostatic latent image on its passage through the screen. As a result of this ion current modulation, a secondary electrostatic latent image is formed due to electric charge applied to an electrically chargeable member such as recording member, etc..

Incidentally, the term "primary electrostatic latent image" as used in the present invention is meant by an electrostatic latent image formed on the screen in accordance with the original image by the afore-described forming process, and the term "secondary electrostatic latent image" is meant by an electrostatic latent image formed on the electricaly chargeable member by modulating the ion current by the primary electrostatic latent image.

The photosensitive screen as shown in the drawing for the explanation of the present invention is basically constructed with the electrically conductive member as the substrate, on which the photoconductive member and the surface insulating member are provided, as mentioned in the foregoing. FIG. 1 is an enlarged cross-sectional view of one embodiment of the photosensitive screen produced in such manner. That is, the screen shown in FIG. 1 is such one that possesses a multitude of tiny openings therein, and is provided with both photoconductive member 3 and surface insulating member 4 around the electrically conductive member 2 as the substrate for the screen in such a manner that a part of the electrically conductive member may be exposed outside.

The electrically conductive member 2 constituting the photosensitive screen 1 is made of a metal material of good electric conductivity such as, for example, nickel, stainless steel, copper aluminium, tin, and so on. Flat plate of such electrically conductive material is subjected to etching treatment to produce numerous tiny openings therein (in this case, the cross-sectional shape of the opening is mostly rectangular). The screen can also be made of a net made by weaving thin metal wires of the abovementioned class or base wires coated with such metal material by the electroplating technique (in this case the cross-sectional shape of the opening is most circular). From the standpoint of required resolving power, or resolution, appropriate number of the tiny openings in the electrically conductive member 2 for the purpose of reproduction in general offices may be that corresponding to 100 to 500-mesh size. Also, when the electrically conductive member is to be produced from the flat plate as mentioned above, the optimum thickness of the raw material is determined in accordance with the mesh size value and the shape of the tiny opening. On the other hand, when the electrically conductive member 2 is to be produced from the woven thin metal wires as mentioned above, the optimum diameter of the thin metal wire may be determined in accordance with the mesh size value to be attained.

For the photoconductive member 3, there can be used various substances such as, for example, sulfur (S), selenium (Se), lead oxide (Pbo), etc., alloys containing sulfur, selenium, tellurium (Te), arsenic (As), tin (Sb), lead (Pb), etc., intermetallic compounds, and so on. These substances are vacuum-deposited onto the substrate 2 to form the photoconductive member 3. In another way, when the photoconductive member is to be formed by the sputtering method, it is possible to adhere those photoconductive substances of high melting point such as zinc oxide (ZnO), cadmium sulfide (CdS), titanium oxide ($TiO_2$), and so forth onto the electrically conductive member. When the photoconductive member 3 is to be formed on the substrate by the spray method, there may be used organic semiconductor such as anthracene, phthalocyanine, PVCz (polyvinyl carbazole), etc.; such organic semiconductor whose sensitivities to coloring matter and Louis acid have been increased; and, further, mixtures of these organic semiconductors and an insulative binder. Besides the above, mixtures of those inorganic photoconductive bodies such as ZnO, Cds, $TiO_2$, PbO, etc., and an insulative binder may also be suited for this spray method for forming the photoconductive member.

For the insulative binder, various organic and inorganic insulative substances which are to be used for the surface insulating member, as will be described hereinbelow, may also be employed.

Incidentally, appropriate thickness of the photoconductive member to be formed on the electrically conductive member 2 by the afore-described method may be from 15 to 80 microns at its maximum, though it depends on the kind and characteristics of the photoconductive substance to be used.

Next, for the surface insulating memeber 4, the material should fulfill the requirements such that it has a high electric resistance, an electric charge sustaining characteristic, and transparency to light at the irradiation step. The material, however, is not always required to have excellent wear resistance property. For the materials which can satisfy the abovementioned requirements, there are: polyethylene, polypropylene, polystyrene, polyvinyl chloride, polyvinyl acetate, acrylic resin, polycarbonate, silicone resin, fluorine resin, epoxy resin, and other organic insulative substance, or copolymers and mixtures of these substances in solvent type, thermal polymerization type, and photo-polymerization type, etc.. These substances can be disposed on the surface insulating member by the spray coating or vacuum evaporation. Vacuum evaporation of ogainic substance of vapor-phase polymerization type such as parylene (a general name for thernoplastic film polymer based on para-xylylene), or inorganic insulative substance is also effective for the purpose of the present invention. Thickness of the insulating member to be formed on the photoconductive member 3 by the abovementioned manner can be determined in relation to the thickness of the photoconductive member 3.

As photosensitive screen for use in the present invention should be electrically conductive at one surface side thereof, it is required to be constructed in such a manner that the electrically conductive member 2 to be the substrate is exposed at the one surface side of the screen. Therefore, when the photoconductive member, the surface insulating member, etc. are to be formed on the electrically conductive member 2, they may better be adhered from one side of the electrically conductive member 2. In this connection, when these substances to be coated inevitably come around the one surface side of the electrically conductive member 2, the surface side of the electrically conductive member 2 may be exposed by grinding the substances which have come around to that side.

The primary electrostatic latent image is formed on the insulating member 4 which covers the substantially entire surface of the screen 1. The effect to be derived from this will be explained in the following.

The attenuation of the primary electrostatic latent image formed on the insulating member 4 is much lower than that formed on the photoconductive member which is in an insulated condition. The reason for this is that, when the pure insulating member and the photoconductive member in its insulated state are compared the former can be said to have a much higher electrical resistance value. On account of this, the screen 1 is able to possess a high electric charge quantity, whereby the primary electrostatic latent image of high electrostatic contrast can be formed. Moreover, in order to increase the electric potential of the primary electrostatic latent image to be obtained on the screen 1, it is preferable that the insulating member 4 cover the screen 1 up to the side surface of the openings, as shown in FIG. 1. The reason for this is that, if the electrically conductive member is exposed to the side surface of the screen openings, the corona ions which come into the screen 1 after the insulating member is slightly charged are all repulsed to flow into the electrically conductive member with the result that it becomes difficult to charge the insulating member at a high electrical potential. Also, as the attentuation of the primary electrostatic latent image formed on the insulating member 4 is very slight, modulation of the ion current over a repeated number of times by one and the same primary electrostatic latent image becomes possible, which in turn makes it possible to perform the so-called retention copying, wherein multitude of reproduced images can be obtained from a single primary electrostatic latent image.

Figure 2:
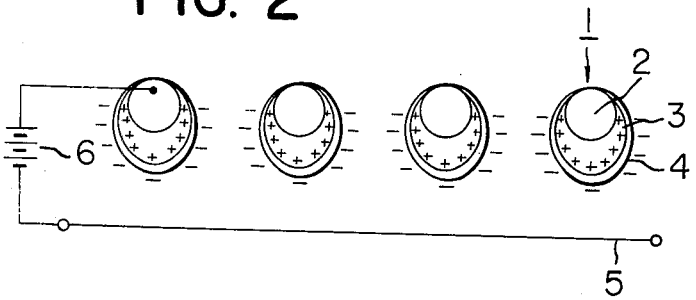
FIG. 2 to 5 are respectively explanatory views of the image forming process using the photosensitive screen shown in FIG. 1.
Figure 3:
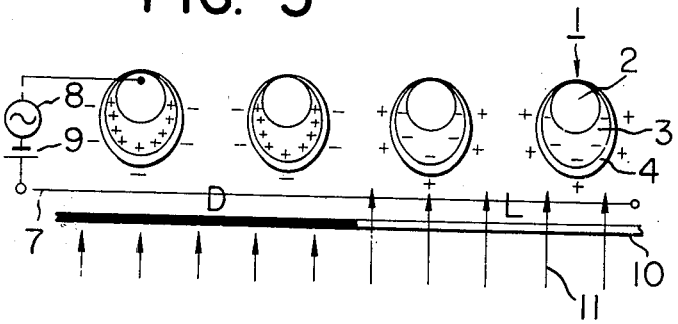
Figure 4:
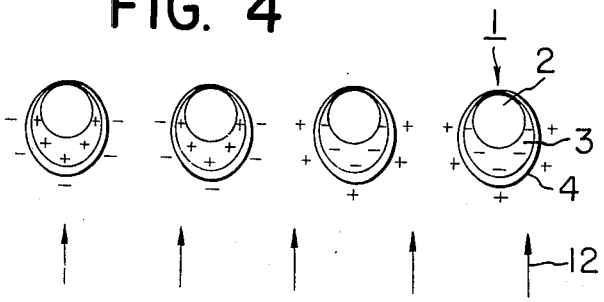
Figure 5:
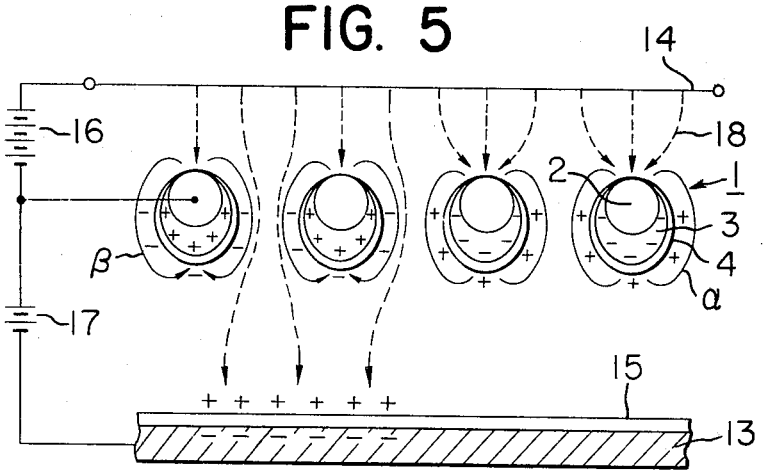

The forming steps of the primary and secondary electrostatic latent images on the photosensitive screen 1 are clearly shown in FIGS. 2 through 5 inclusive, wherein FIG. 2 shows the primary voltage application step to be performed on the screen, FIG. 3 shows the image irradiation and the secondary voltage application step, FIG. 4 shows the overall irradiation step, and FIG. 5 shows the secondary electrostatic latent image forming step which is done by modulating the ion current by way of the primary electrostatic latent image formed on the screen through the abovementioned various steps.

The electrophotographic method applicable to the present invention will be explained hereinbelow with reference to a case, wherein a photoconductive substance consisting of selenium (Se) and alloy containing the same with the hole as the principal carrier thereof is used as the substance for forming the photoconductive substance.

For the voltage application device for use in the voltage application step, there can be used various known voltage application means such as corona discharger, roll charger, and so forth. Of these, the corona discharger is considered particularly favorable in its electric charging efficiency, hence the following explanations will refer to the corona discharger as the voltage application means.

The primary voltage application step as shown in FIG. 2 carries out uniform electric charging of the screen in the negative polarity polarity by means of the corona discharger as the voltage application means. In this drawing figure, the reference numeral 5 indicates a corona wire for the corona discharger, and 6 designates a power source for the corona wire. By this electric charging, the negative charge is accumulated on the surface of the insulating member 4, whereby a positive electric charge layer opposite to the charge polarity of the abovementioned charge is formed in the vicinity of the insulating member 4 on the photoconductive member 3. When the interface between the photoconductive member 3 and the electrically conductive member 2 as well as the photoconductive member per se possess such characteristic that permits majority carriers to be injected therein, but does not permit minority carrier to be injected, as the consequence of which the screen as a whole possesses a certain rectifiability, it is possible to form an electric chage layer in the vicinity of the insulating member 4 in the photoconductive member 3 as mentioned above by the carrier injection even at a dark portion thereof. However, in the case of the screen having neither the rectifiability as mentioned above, nor incapable of forming the electric charge layer as mentioned above by the primary voltage application, such primary voltage application can be done by the method of charging the insulating member as taught in U.S. Pat. No. 2,955,938.

In the abovementioned voltage application step, when a voltage is to be impressed on the screen by means of the voltage application device, it is preferable to perform such voltage application from the surface of the screen 1 where the insulating member 4 is present (this surface will hereinafter be called "surface A"). Inversely, when the corona discharge, etc. is imparted to the surface of the screen 1 where a part of the electrically conductive 2 is exposed (this surface will hereinafter be called "surface B"), the corona ions flow into the electrically conductive member 2 with the consequence that the insulating member 4 is difficult to be charged sufficiently.

The result of the simultaneous image irradiation and the second voltage application steps onto the screen 1 which has undergone the abovementioned primary voltage application step is shown in FIG. 3. In this drawing figure, the reference numeral 7 designates the corona wire for the corona discharger, 8 designates a power source for the corona wire 7, 9 denotes a bias power source, 10 indicates an original image, wherein "D" designates a dark portion of the image and "L" designates a bright portion thereof, and an arrow 11 indicates light from a light source (not shown). In FIG. 3, electric discharge of the screen 1 is done by the corona discharge from the corona wire 7 impressed with an alternating current voltage, on which a direct current voltage in the positive polarity is superposed, so that the surface potential of the insulating member 4 may become substantially the positive polarity. When the AC corona discharge is used, the surface potential of the insulating member 4 must become substantially zero potential owing to alternate discharge between the positive and the negative polarities. In practice, however, as the phenomenon of the negative corona discharge generation is stronger than the positive corona discharge generation, it is difficult to render the surface potential of the insulating member 4 to be positive as mentioned above. In order to reduce such tendency, measures are taken to superpose a positive bias voltage on an voltage, or to decrease the negative current in the AC power source. It goes without saying that, besides utilization of the AC voltage, a direct current corona discharge in the opposite polarity to that of the primary voltage application may be applied for the purpose of the secondary voltage application so as to render the surface potential of the insulating member 4 to be in the opposite polarity to that of the primary voltage application.

As stated above, when the surface potential of the insulating member 4 is rendered positive, the substance constituting the photoconductive member 3 becomes conductive in the bright portion L of the image due to the image irradiation, as the result of which the surface electric charge of the insulating member 4 becomes positive. However, in the dark portion D, the surface charge of the insulating member 4 remains negative, owing to the positive charge layer existing at the side of the insulating member 4 on the photoconductive member 3.

In case the substance constituting the photoconductive member 3 includes a persistent photoconductive material, the relationship between the image irradiation step and the secondary voltage application step in the case of the light transmission type image forming system is such that both steps may be performed sequentially, instead of their simultaneous performance. The direction of the image irradiation should preferably be done from the surface A of the screen 1. While it is possible to carry out this image irradiation from the surface B, the resolution and sensitivity might be inferior to those of the former case. For the image irradiation, light rays are generally employed, althrough, besides the light rays radiation rays against which the substance constituting the photoconductive member 3 exhibits reaction, may also be used.

Considering now the polarity changing speed of the electric potential on the insulating member 4 of the screen 1 in the abovementioned steps, it is noted that the portion which faces the corona wire 7 of the insulating member 4 changes the most quickly, and the side surface portions substantially sandwiching the portion changes later than the facing portion. Accordingly, at the image irradiation portion, the electric potential at the surface B of the screen 1 corresponds to that of the electrically conductive member 2, so that the potential gradient becomes higher from the surface B toward the surface A.

FIG. 4 shows a result of carrying out a uniform exposure as a subsequent overall irradiation step on the entire surface of the screen 1 which has undergone both image irradiation and second voltage application steps. In the drawing, arrows 12 designate light rays from a light source (not shown). By this overall irradiation, the potential at the dark portion D of the screen 1 changes in proportion to the electric charge quantity on the surface of the insulating member 4. Thus, the relationship between the electrostatic latent image contrast Vc to be resulted and the charged potential Va due to the primary voltage application step can be represented by the following equation (1).

$$Vc = \frac{Ci}{Ci + Cp} Va \tag{1}$$

(where: Ci is a static capacitance of the insulating member 4 and Cp is a static capacitance of the photoconductive member 3)

When an ordinary three-layer photosensitive body consisting of the electrically conductive substrate, the photoconductive layer, and the surface insulating layer is used, the capacitance ratio between the insulating layer (Ci) and the photoconductive layer (Cp) should preferably be 1 : 1 or so. However, in the electrophotographic method using the photosensitive screen, particularly, in the retention copying as in the present invention, this capacitance ratio (Ci : Cp) of 2 : 1 or so would yield very effective result. Also, the coating thickness of the photoconductive member 3 becomes continuously thin from the surface A toward the surface B of the screen 1. On account of this, as the electric charge layer in the photoconductive member 3 is extinguished by the overall irradiation, the electric potential at the dark portion of the image, gradually shifts to a high negative value from the surface B toward the surface A of the screen 1. Although the overall irradiation step is not always required to be performed, quick formation of the primary electrostatic latent image having a high electrostatic contrast on the screen 1 can be secured by this overall irradiation step.

FIG. 5 shows the secondary electrostatic latent image forming step, wherein a positive electrostatic latent image of the original is being formed on the recording member from the primary electrostatic latent image on the screen 1. In the drawing, the reference numeral 13 designates an opposite electrode which confronts to a corona wire 14 of the corona discharger. The reference numeral 15 designates a recording member such as electrostatic recording sheet, etc., which is so disposed that its electrically chargeable surface is faced to the screen 1, and its other surface is made to contact the opposite electrode 13. The recording member 15 is spaced apart from the surface A of the screen 1 at an appropriate interval of about 1 to 10 mm.

When the secondary electrostatic latent image is to be formed on the recording member 15, corona ion current is applied from the corona wire 14 in the direction of the recording member 15. At this time, the potential difference is continuously changing from the surface A to the surface B at the bright portion L of the screen 1, whereby an electric field as shown by solid lines $\alpha$ is created. Owing to this electric field, passage of the corona ions through the openings of the screen is hindered with the result that the corona ions flow into the exposed portion of the electrically conductive member 2. In this case, if the surface B (the side where the electrically conductive member is exposed outside) is entirely covered with the insulating member, it is charged to the polarity of the ion emitting from the corona wire 14, and passage of the corona ion through the screen openings is accelerated due to the electric charge on this electrically conductive member. That is to say, as the corona ion even passes through the bright portion of the image, there inevitably occurs fogging on the secondary electrostatic latent image to be formed on the recording member 15. In contrast to this, as the electric potential at the dark portion of the screen 1 is continuously and smoothly changing from the surface B to the surface A (the side where the insulating member is present), an electric field as shown by solid line $\beta$ is created. Owing to this electric field, the corona ion, in spite of its being in the opposite polarity to that of the electrostatic latent image on the insulating member 4, effectively reaches the recording member 15 in a state of its offsetting the polarity of this latent image. Inversely, when the original image is to be formed on the recording member with a negative electrostatic latent image, a voltage of the same polarity as that of the charge on the insulating member 4 of the dark portion of the screen 1 is impressed. Incidentally, the reference numerals 16 and 17 in the drawing designate power sources, of which the power source 16 is for the corona wire 14, and the power source 17 is for the electrically conductive substrate. The voltage application is done in such a way that potential difference may be created in the direction of the corona wire 14 to the electrically conductive substrate 13 through the screen 1.

The voltage to be applied to the corona wire 14 may not only be the d.c. voltage as mentioned above, but also an a.c. voltage can be used. In the case of using the a.c. voltage, if the primary electrostatic latent image on the screen 1 is in the above-stated condition, a positive electrostatic latent image can be obtained by applying a negative voltage to the side of the electrically conductive substrate 13, while a negative electrostatic latent image can be obtained by applying a positive voltage thereto. The reference numeral 18 in the drawing designates the corona ion current from the corona wire 14.

For the recording member 15, there can be used, not only the two-layer structure consisting of a chargeable layer and an electrically conductive layer as in the electrostatic recording paper, but also the insulating member such as polyethylene terephthalate in film form, etc.. In this case, the insulating member in the film form and the opposite electrode 13 should closely contact each other, otherwise irregularities occur on the secondary electrostatic latent image formed. As a means for removing such defect, other than by the opposite electrode 13, it is effective to apply to the recording member 15 a voltage to form a bias field by the corona discharge.

The reason why the use of the abovementioned screen 1 is particularly effective for the retention copying is considered to be that (1) a primary electrostatic latent image having a smooth variation in the electric potential is formed on the insulating member 4 at the screen openings, and that (2) the electrically conductive member 2 exposed to the side of the surface B of the screen 1 has a function of absorbing excessive corona ion current while is liable to extinguish or disturb the primary electrostatic latent image.

In the case of performing the retention copying, when the secondary electrostatic latent image is to be formed on the electrically chargeable member, there takes place such a phenomenon that quantity of the ion current passing through the screen 1 is small only at the initial stage, or from the initial stage to a few subsequent times of the ion current modulation. When the secondary electrostatic latent image formed on the chargeable recording member is developed under such condition, the developed visual image will be different in the image density between the first one and that obtained at any later stage. The cause for this phenomenon is considered to be due to that a part of the corona ion current flows from the openings of the screen 1 toward a part of the surface B, i.e., toward the side of the screen where the modulating ion is to be applied. When this flowing phenomenon of the ion current continues until it reaches an equilibrated state, the corona ion flowing from the screen openings toward a part of the surface B becomes extinguished. The time for the flowing ion current to attain the above equilibrated condition depends on the shape and structure of the screen. It has been found out that such undesirable phenomenon to take place at the initial stage of the retention copying can be prevented by the following two methods.

As the first method, when the ion current modulation is to be performed for a plurality of times by means of one and the same primary electrostatic latent image, intensity of the corona discharge current for the modulation is increased to approximately 10 to 100% of the ordinary current intensity by increasing the voltage to be applied to the corona wire 14 which constitutes the source of the modulating ion current, or by varying the distance between the corona wire 14 and the screen 1 for the ion current modulation of only the initial stage or from the initial stage to subsequent few stages. In other words, intensity of the modulating ion current at the initial stage is controlled at the formation of the secondary electrostatic latent image.

As the second method, when the modulation of the ion current is to be performed for a plurality of times by means of one and the same primary electrostatic latent image, a corona discharge of the same polarity as that of the modulating corona discharge is applied, as a part of the ion current modulating step, from the side of the screen 1 where the modulating ion is applied, prior to commencement of the modulation and separate from the modulating corona discharge. In this case, the corona discharge current may range from a few fractions to a few times with respect to the ordinary current. However, in the second method, presence of the opposite electrode 13 to the corona wire 14 is preferred for the following reasons. That is, in the absence of the opposite electrode 13 impressed with a voltage, those corona ions having no place to go adhere to the principal portions of the primary electrostatic latent image to disturb or eliminate the primary electrostatic latent image on the screen 1 with the consequence that favorable secondary electrostatic latent image becomes hardly obtainable at the time of the ion current modulation. The preliminary voltage application to the screen prior to commencement of the ion current modulation as mentioned above is called 'preliminary step'.

In the abovementioned secondary electrostatic latent image formation, when the corona discharge impressed with a d.c. voltage is used, the secondary electrostatic latent image formed on the recording member, etc. is of a single polarity, either positive or negative. On account of this, when the electric potential of the latent image is low, there takes place in some cases the fogging phenomenon at the time of the development to make it unable to obtain reproduced image of good quality. In spite of this unfavorable phenomenon, the image contrast in the secondary electrostatic latent image can be increased by the following method. That is to say, the polarity of the voltage to be applied to the discharge electrode of the corona ion current to be impressed on the recording member, etc. through the screen for forming the secondary electrostatic latent image, and the polarity of the voltage to be applied to the electrically conductive substrate facing the corona discharge electrode are mutually different with respect to the electrically conductive member of the screen. Examples of such mutually different polarity of the voltage to be applied are that an a.c. voltage is applied with its phase being shifted by 180° each other, or more than one set of a d.c. corona discharge having both positive and negative polarities are applied. One example of such situation will be explained in the following with reference to FIG. 6.

Figure 6:
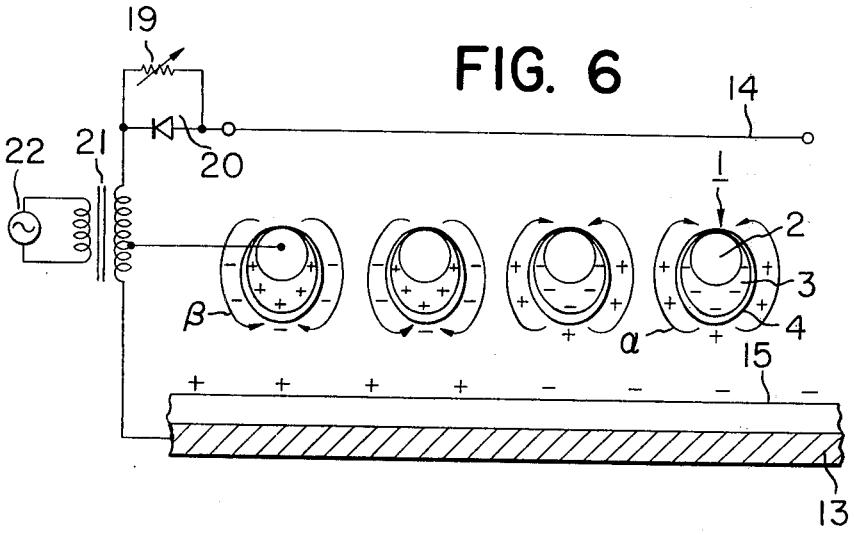
FIG. 6 is a view explaining a case, wherein AC voltage is used for the process step shown in FIG. 5.

The construction of the apparatus as shown in FIG. 6 is mostly the same as that of FIG. 5, hence the substantially same parts are designated with the same reference numerals and symbols. Besides the abovementioned common construction, the apparatus of the FIG. 6 is provided with a variable resistor 19, a rectifier 20, a transformer 21, and an a.c. power source 22. In this method of the ion modulation, the screen structure and electrostatic latent image forming process are not limited to the abovementioned construction, but any construction, in which polarity of the electric field at the openings of the screen 1 (i.e., the primary electrostatic latent image) is mutually opposite on the bright and dark portions of the original image, can serve for the purpose of the present invention. When the a.c. power source 22 and the transformer 21 having intermediate terminals are used as in the basic apparatus shown in FIG. 1, an output with its phase being shifted by 180° with respect to the electrically conductive member 2 can always be obtained. One of the intermediate terminals is connected to the corona wire 14 of the corona discharger through the variable resistor 19 and the rectifier 20, and the other is connected to the opposite electrode. In this case, the variable resistor 19 and the rectifier 20 function to adjust intensity of the positive or negative polarity of the a.c. voltage, whereby the condition of the secondary electrostatic latent image on the recording member 15 can be adjusted. The space interval between the screen 1 and the recording member 15 may appropriately be 1 to 10 mm, and the voltage to be applied across the screen 1 and the recording member 15 may range from 0.5 to 5 KV or so at its peak value. In order to constantly obtain an output, whose phase is shifted by 180° as mentioned above, by the use of the a.c. power source 22, other electric components than the variable resistor 19 and the rectifier 20 may, of course, be utilized. It is also possible to apply a.c. corona discharge by the corona discharger from the side opposite to the screen 1 through the recording member 15 without use of the opposite electrode 13. In any case, when the corona ions for the ion modulation is the alternating current, it is desirable that electric field in the mutually same direction be impressed between the corona wire 14 and the screen 1 as well as between the screen 1 and the opposite electrode 13 over the entire length of time for the ion current modulating step. From such fact, use of the transformer 21 is merely illustrative of such possibility. This construction can also be replaced by the use of two d.c. power sources of mutually opposite polarities which are controlled by relays, etc.. By the use of such method, the opposite electrode 13 becomes negative in its polarity, while the corona wire 14 is in the positive polarity, whereby the positive ions pass through only the portions of the screen 1 where the polarity is negative, and adhere to the recording member 15. Similarly, while the corona wire 14 remains to be negative, the opposite electrode 13 is in the positive polarity, whereby the negative ions pass through only the portions of the screen 1 where the polarity is positive, and adhere to the recording member. In this way, there is formed on the recording member 15 the secondary electrostatic latent image having the negative polarity in the dark portion and the positive polarity in the bright portion thereof. When this secondary electrostatic latent image is developed by the use of coloring particles such as toner and the like having the positive polarity, a reproduced image free from the fogging can be readily obtained. Further, tonality of this reproduced image can be adjusted by the variable resistor 19. Needless to say, use of the negative toner makes it possible to produce a negative image.

As the result of studies and researches by the present inventors on the factors for the limited number of times to enable the ion current modulation to be possibly repeated through one and the same primary electrostatic latent image in the latent image forming step as mentioned in the foregoing, the following facts have been discovered. That is, for the factor affecting reduction in capability of the ion current modulation, the modulated corona ion current is considered to have disturbed or eliminated the primary electrostatic latent image in view of the fact that polarity of the modulating corona ion current and the latent image potential forming the dark portion in the primary electrostatic latent image is in the mutually opposite relationship. However, when the voltage 17 between the screen 1 and the recording member 15 in FIG. 5 is sufficiently high, e.g., 1 KV/mm and above, there is less possibility of the primary electrostatic latent image being eliminated, since the ion current flows in sufficient quantity during the modulating operation. In other words, the main cause for reduction in the modulating capability has been found to be inferable from the facts that the modulating corona ions adhere to the insulating member 4 existing on the surface part near the electrically conductive member 2, a part of which is exposed from the vicinity of the side surface of the screen openings, and that the thus adhered ions cause the electric field in the vicinity of the openings to vary, whereby efficiency in passage through the openings of the corona ion current to be applied later on is lowered. This condition will be explained in more detail in the following with reference to FIGS. 7A and 7B.

Figure 7A:
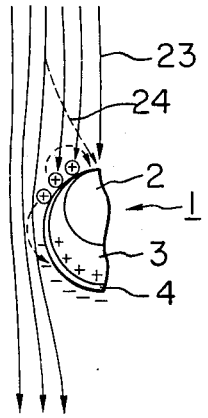
Figure 7B:
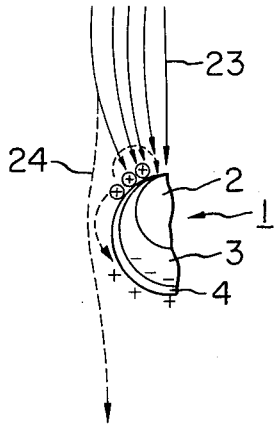

FIGS. 7A and 7B diagrammatically illustrate the ion current flow during the modulation and the cross-section of the screen 1 in an enlarged scale, wherein FIG. 7A shows the region to cause the positive ion to pass, while FIG. 7B shows the screen openings of the region where passage of the positive ions is to be hindered. The solid line 23 indicates the direction of the electric field and the flow of the positive ions. While the positive ions are being modulated by the screen, there accrues adherence and accumulation of the positive ions as shown with ⊕ on the insulating member 4 of the ion source side in accordance with the number of times of the modulation performed. Owing to this adherence and accumulation of the positive ions, flow of the positive ions as shown by the solid line 23 changes in part as shown by a broken line 24, and the positive ions flow into the place near the electrically conductive member 2 at the portion where the positive ions pass through, as in FIG. 7A, whereby the quantity of the passing positive ions reduces. On the other hand, in the passage hindering portion of the positive ions, the positive ions are repulsed from the vicinity of the electrically conductive member 2, and flow toward the screen openings to pass therethrough as shown by the broken line 24. As the result of this, the secondary electrostatic latent image shown in FIG. 7A lowers its electric potential as the passing quantity of the positive ions decreases. Further, the secondary electrostatic latent image in the region as shown in FIG. 7B results in formation of unnecessary latent image, i.e., fogging, due to the positive ions which have already passed therethrough. When such secondary electrostatic latent image is developed for visual image with a negatively charge toner, the resulting visual image will be of low color contrast, further accompanying the undesirable fogging of the toner. Here, if there will be used the corona discharger as the ion source, and as the field intensity between the discharge electrode of the discharger and the screen is higher, the abovementioned phenomenon becomes remarkable. When the retention copying is performed at a high speed, a large amount of corona ions are applied to the screen with the consequence that strong field acts between the screen and the corona discharging electrode, hence the phenomenon poses a serious problem. Further, when the scren construction is such that there is no insulating member which covers up to the vicinity of the side surface of the screen openings, such problem may not happen. However, even in such screen, it is impossible to obtain the primary electrostatic latent image having high electrostatic contrast for the foregoing reasons, hence it is difficult to carry out the retention copying over multiple number of times.

Figure 8:
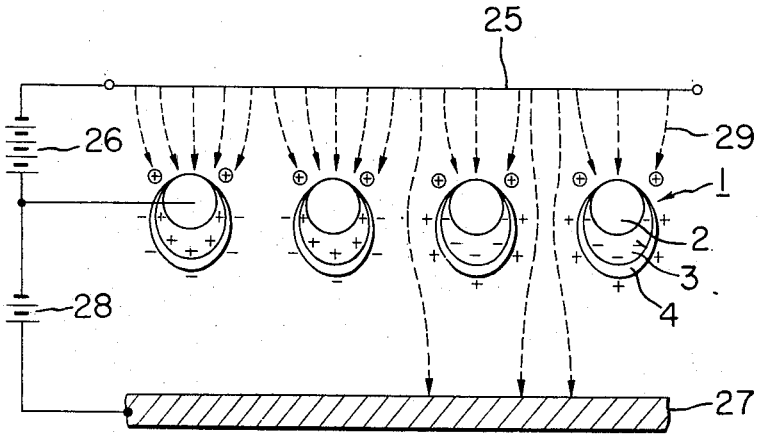
FIG. 8 is an explanatory view of the adjustment process according to the present invention.

In the following, solution to the cause for lowering in the ion current modulation effect as mentioned above will be discussed. FIG. 8 shows a step according to the present invention for removing unnecessary electric charge due to the ions adhered to the screen, which causes lowering in the ion current modulation during the retention copying. In FIG. 8, the electric charge which has been adhered to the side of the screen where the modulating ion is to be applied during the modulating operation and should be removed is in the positive polarity as has already been explained with respect to the secondary electrostatic latent image forming step in FIG. 5. On account of this, negative corona discharge, which is in opposite polarity to that of the modulating, is carried out to the screen 1 by applying a voltage from the power source 26 through the corona wire 25. At this time, the opposite electrode 27 is provided on the opposite side of the corona wire 25 through the screen 1, and a voltage is applied to the opposite electrode 27 from the power source 28 so that the corona ions generated from the corona wire 25 may be directed to the screen 1. If this opposite electrode 27 is not provided, the negative charge to form the bright portion of the primary electrostatic latent image at the side surface where the electrically conductive member of the screen is not present is eliminated by the ion current which has gone around to that side. As the result, there might occur the fogging phenomenon on the reproduced image to be obtained by the subsequently carried out retention copying. However, provision of this opposite electrode 27 is not always required, if the corona discharge from the corona wire 25 is carried out to the weakest degree. Where there should exist a chargeable layer on the opposite electrode 27, formation of the secondary electrostatic latent image on this layer is also possible. This process step will hereinafter be called 'adjustment step'. Through experiments, it has been verified that the number of times for the ion current modulation is remarkably increased by combining this adjustment step and the retention copying. This adjustment step may either be carried out alternately with the ion current modulation at the time of preforming the retention copying, or once every definite number of times of such ion current modulation. The optimum intensity of the corona discharge from the corona wire 25 depends on the structure and configuration of the screen used, and further on the intensity of the corona discharge to be applied at the time of the retention copying. The permissable range thereof, however, is very broad. As is apparent from the foregoing explanations, when an a.c. field which is synchronous with the a.c. corona discharge is applied between the screen 1 and the recording member 15 at the time of forming the secondary electrostaic latent image by the use of the a.c. corona discharge, there can be formed such secondary electrostatic latent image as having mutually opposite polarities between its bright portion and dark portion. At the same time, accumulation on the screen 1 of the electric charge of any specific polarity which is liable to lower the ion current modulation efficiency as mentioned above can be prevented. In FIG. 8, a symbol ⊕ designates a positive ion charge adhered to the side of the ion current generation, and the broken line 29 indicates the corona ion current to remove such unnecessary positive ion charge.

FIGS. 9 to 12 exemplify screens of various types which are suited for the retention copying, and in which the unnecessary ions tend to adhere at the time of the retention copying, to the side of the screen where the ion current is to be applied due to the insulating member being present in part or in more quantity to the ion current application side of the screen. These screens are of course applicable to the electrostatic latent image forming step shown in FIGS. 2 to 5. Furthermore, similar to the screen of FIG. 1, the formation of the latent image is possible by combining the discharge step and the image irradiation step, etc., the details of which are clearly described in the copending application No. 480,280, filed June 17, 1974, to the same assignee as the present application. From the aforementioned reasons, it is preferable for the purpose of the ion modulation at the screen that the ion current generating source be disposed to the side where the electrically conductive member is exposed or present.

Each of these modified screens will be explained in detail in reference to the enlarged cross-sectional views of FIGS. 9 to 12.

Figure 9:
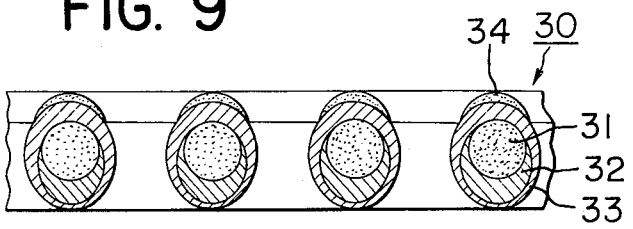
FIG. 9 to 12 are respectively enlarged cross-sectional view of other embodiments of the screen capable of performing the image formation, i.e., retention-copying, according to the present invention.

In FIG. 9, the screen 30 is provided with the photoconductive member 32 at substantially one surface side of the electrically conductive member 31 as the base, on which the surface insulating member 33 is further provided so as to cover both members 31 and 32. On one part of this surface insulating member, there is further provided another electrically conductive member 34 which is different from the electrically conductive member 31. The electrically conductive member 31 is further coated thereon with vacuum-evaported metals such as aluminum (Al), copper (Cu), gold (Au), indium (In), nickel (Ni), and so on, an electrically conductive resin containing therein quarternary ammonium salt, mixtures of fine metal powder such as silver (Ag), copper (Cu), etc., or carbon powder and a binder resin, which is spray-coated thereon.

Figure 10:
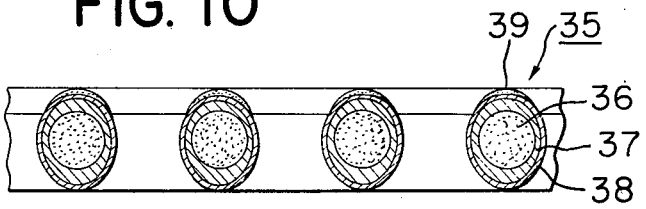

In FIG. 10, the screen 35 is so constructed that the photoconductive member 37 is provided in a manner to cover the electrically conductive member 36. The remaining construction is the same as that of the screen of FIG. 9. The reference numeral 38 designates the surface insulating member, and 39 designates another electrically conductive member provided on the surface insulating member 38.

Figure 11:
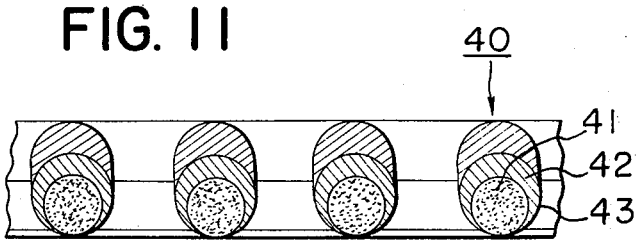

In FIG. 11, the screen 40 is so constructed that the photoconductive member 42 is provided in such a manner that a part of the electrically conductive member 41 as the base may be exposed outside. The surface insulating member 43 is further provided on this photoconductive member 42 in such a manner that a part thereof may be exposed to the openings of the screen.

Figure 12:
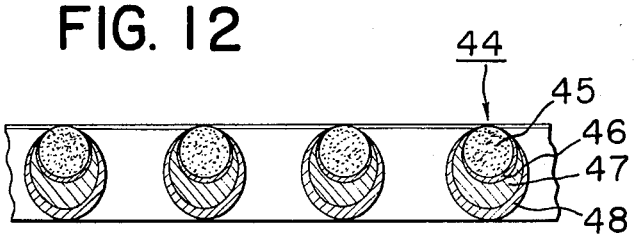

In FIG. 12, the screen 44 is so constructed that the insulating member 46, the photoconductive member 47, and the surface insulating member 48 are coated in sequence as mentioned in such a manner that a part of the electrically conductive member 45 may be exposed outside.

The method for production and the material to be used for production of the above mentioned screens may be the same as those for the screen shown in FIG. 1.

Having completed explanations of the image forming process according to the present invention, one embodiment of an apparatus, in which the image forming method has been applied, will now be described in reference to FIG. 13.

Figure 13:
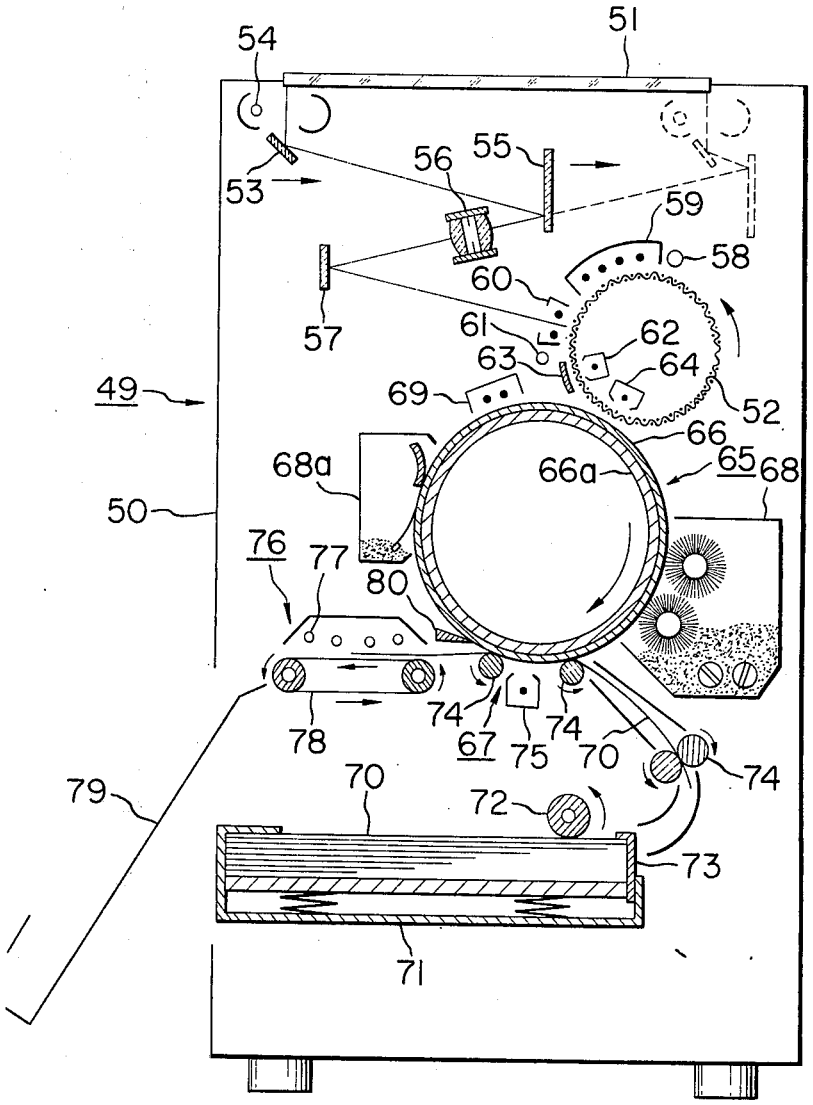
FIG. 13 is a schematic cross-sectional view of an image forming apparatus embodying the present invention.

FIG. 13 schematically illustrates construction of an apparatus for forming reproduced images on plane paper material. In the drawing, the reference numeral 50 of the reproduction apparatus 49 designates outer walls of the apparatus. An original image to be reproduced is placed on an original stand 51 made of a transparent material such as glass, etc. and fixed on the top surface part of the outer wall 50 of the apparatus. That is, the original stand 51 is not moved, but image irradiation to the photosensitive screen 52 is done by an optical means including movable mirrors fixed mirrors, lens system, and so forth. The optical means belongs to the known technique, wherein the first mirror 53 moves to a position at the right end in the drawing as shown by dotted lines along with an original image illuminating lamp 54 to cover the whole distance of the image stand 51 at a speed of V. On the other hand, a second mirror 55 moes synchronously with movement of the mirror 53 to a position at the right end of the drawing also shown by dotted lines at a speed of V/2. The original image led by the first and second mirrors 53 and 55 is further guided to the screen 52 through a lens system 56 having an aperture mechanism and a fixed mirror 57. The screen 52 formed in an endless shape is of the same construction as that shown in FIG. 1, with the side surface where the electrically conductive member is exposed being made the inner side of this endless screen. On the other hand, formation of the primary electrostatic latent image by means of this photosensitive screen 52 is carried out by the process steps as clearly explained with reference to FIGS. 2 to 4. In the drawing, various component parts are shown to surround the screen 52, of which one designated by a reference numberal 58 is a pre-exposure lamp which is provided to use the photoconductive member constituting the screen 52 in its constantly stabilized photo-hysteresis condition; one designated by a reference numeral 59 is the corona discharger which is the primary voltage application means, and which takes sufficient length in the circumferencial direction of the screen 52 so as to charge it to a sufficient voltage level; one designated by a reference numeral 60 is another corona discharger which is the secondary voltage application means and which is so constructed that a part of the shield plate of the discharger 60 is optically opened to permit the image to be irradiated on to the screen 52 through the discharger 60; and one designated by a reference numeral 61 is a lamp for the overall irradiation of the screen.

The formation of the secondary electrostatic latent image by means of the screen 52 is also carried out by the process steps as explained in reference to FIGS. 5 to 8. As shown in FIG. 13, below the lamp 61 for the overall irradiation, there is provided means for removing harmful charge adhered to the screen as already explained with respect to FIG. 8. That is to say, the corona discharger 62 provided inside the endless screen 52 is used to discharge any harmful charge accumulated or adhered to the screen as in the abovementioned preliminary step or adjustment step, while the opposite electrode 63 outside the screen 53 is to prevent the surface charge on the screen 53 from being eliminated at the time of the abovementioned discharge. This opposite electrode 63 is disposed in confrontation to the abovementioned discharger 62 through the screen 52. It is preferable that this opposite electrode be manufactured with a breadth broader than that of the screen 52. Further, if the screen is of a planar shape the surface of the elctrode facing the screen is made in a flat plate, and , if the screen is in the cylindrical form as in the embodiment of FIG. 13, the surface may be formed in a concentric arcuate or flat plate, although the configuration of the electrode is not so limitative.

The corona discharger 64 below and contiguous to the abovementioned discharger 62 is for generating the modulating corona ion current. The secondary electrostatic latent image is formed on the surface insulating layer 66 of the drum 65 which is oppositely provided against the discharger 64 through the screen 52. The insulating layer 66 of the drum 65 is simply placed or adhered onto the electrically conductive substrate 66*a* which functions as the opposite electrode as explained in the foregoing with respect to the ion modulation in FIG. 5. The drum 65 rotates in the arrow direction in correspondence to the rotational direction and speed of the photosensitive screen 52. The secondary electrostatic latent image formed on the insulating layer 66 is developed by conventional toner developing means 68 to become a toner image. The thus developed toner image is transferred onto reproduction paper as the recording member which consists of plane paper and which has been conveyed to an image transfer position 67. Residual toner on the insulating layer 66 which has passed through the image transfer position 67 is removed by cleaning means 68*a* using a blade, etc., after which the layer 66 is rendered to be uniform in its surface potential by a corona discharger 69 so that it may be ready to form again the secondary electrostatic latent image, when necessary. On the other hand, the reproduction paper 70, on which the toner image to to be transferred, is loaded in a cassette 71, which is separately taken out of the cassette, sheet by sheet, by means of a feed roller 72 and a separation pawl 73, and is conveyed to the image transfer position. In the drawing, reference numeral 74 designates a forwarding roller, 75 refers to a corona discharger for applying a bias voltage to the reproduction paper 70 at the time of transfer of the toner image. The reproduction paper 70 which has passed through the image transfer position 67 is subjected to fixation of the transferred toner image by a heater 77 in a heat-fixing means 76, after which it is conveyed to a receptable 79 provided outside the apparatus for receiving the image-bearing reproduction paper carried by a conveyor belt 78.

In the following, one actual example of forming reproduced image by the use of the reproduction apparatus 49 having the afore-described construction will be presented. The photosensitive screen 52 same as that shown in FIG. 1 is manufactured by first weaving stainless steel wires of 30 microns in diameter into a metal net of 250 meshes so as to be made into the electrically conductive member as the base, then applying onto this electrically conductive member cadmuim sulfide (Cds) dispersed in a resin and an insulating body of a resin, respectively, by means of the spray coating method from one surface side thereof in such a manner that the maximum coating thickness may become approximately 50 microns and 20 microns, respectively. The thus manufactured screen is fitted on a cylindrical frame body having a window portion, and the screen appearing at the window portion is used for the image formation. When the screen 52 formed in the cylindrical shape is caused to rotate at a peripheral speed of 160 mm/sec., then a d.c. voltage of +8kv is applied to the discharger 59 as the primary voltage application, subsequently and a.c. voltage of 8kv is applied to the discharger 60 as the secondary voltage application, simultaneously with image irradiation at the bright portion with a luminance of 10 lux-sec. or so, and finally the overall irradiation of the image is carried out with the use of the lamp 61 of 400 lux-sec., there can be obtained on the screen 52 the primary electrostatic latent image having an electrostatic contrast of 300 volts. In the subsequent formation of the secondary electrostatic latent image, both screen 52 and drum 65 are caused to rotate at the peripheral speed of 400 mm/sec. The space interval between both members is set 3 mm at the secondary electrostatic latent image forming position, in which case the electrically conductive substrate 66*a* of the drum 65 is grounded, while the electrically conductive member of the screen 52 is impressed with a voltage of −5kv. Then, the corona ion modulation is carried out by applying a voltage of −12kv to the corona wire of the corona discharger 64 (a voltage of −7kv to the electrically conductive member of the screen 52), and a voltage of −5kv to the shielding member of the discharger 64. As the result of this ion current modulation, there can be obtained on the insulating layer 66 of the drum 65 the secondary electrostatic latent image having a potential contrast between the bright portion and the dark portion of the image of 400v. The thus obtained latent image on the insulating layer is then developed for visual image by the developing means 68 using the positively charged toner. In this case, when the retention copying is performed without the abovementioned adjustment step, the image reproduced on the 100th sheet of the reproduction paper is found to lower its potential contrast to 350v accompanied by a tendency to generate fogging of the toner on the developed image. In contrast to this side, when a voltage of −8kv is applied to the screen 52 which is spaced apart from the opposite electrode 63 for 3 mm, and the adjustment step of applying a voltage of +2kv to the corona wire of the corona discharger 62 (a voltage of +7kv to the electrically conductive member of the screen) is incorporated in the retention copying to produce a desired reproduced image, the decrease in the potential contrast on the insulating layer 66 is found to be 8% or so even in the resulted reproduced copy of the 100th sheet. Moreover, variation in the reproduced image at the time of the development is scarcely different from that of the first sheet, hence the image of good quality, which is of practical value, can be obtained. It should be noted that such a sight decrease in the potential contrast in the retention copying at the time of applying the present invention can be successfully solved by varying either stepwisely or at once the voltage to be applied to the corona discharger 64 during the retention copying. Also, not only the decrease in the potential contrast can be prevented, but also possible number of times for the retention copying can be increased by this fine adjustment of the voltage application. When the voltage to be applied to the corona discharger 64 is to be varied as such, the voltage to be applied to the corona discharger 62 may be either constant or interrelated with intensity of the voltage to be impressed on the discharger 64.

In the foregoing, one actual example of the image forming method according to the present invention has been described. It should however be noted that, in embodying the concept of the present invention into a workable apparatus, it is not always necessary to use two corona dischargers 62 and 64 as in the apparatus 49 of FIG. 13, but the discharger 64 for the ion current modulation may also be used as the discharger for adjustment. In other words, the present invention is feasible, even when the polarity of the voltage to be applied to the electrically conductive member of the screen 52 as well as the voltage to be applied to the discharger 64 for the ion current modulation are changed over at the time of practicing the retention copying for once every several sheets or a few tens of sheets of the reproduction paper. Although, in this case, the number of times for the retention copying decreases in a certain definite time period in comparison with the case where the two dischargers 62 and 64 are utilized as in the apparatus 49 of FIG. 13, the construction of the whole apparatus will be advantageously simplified as compared with the former.

As explained in the foregoing, the present invention is directed to the so-called retention copying of the original image to be reproduced, wherein a primary electrostatic latent image is formed on a photosensitive screen, ion current is modulated by means of one and the same primary electrostatic latent image over as many numbers of times as possible in a stable state. Furthermore, the present invention adds to its image forming process an adjustment step along with the ion current modulating step so as to prevent passage of the corona ion current from becoming distrubed during its modulation. The adjustment step is to remove harmful electric charge adhered and accumulated onto the screen caused by applying the modulating ion current to the screen through application of ion currents containing therein ion current of an opposite polarity to that of the modulating ion current. An example of application of the adjustment step to the secondary electrostatic latent image forming step will be explained. In this case, the ion current modulation and the adjustment step may be carried out alternately at every time, or the adjustment step may be carried out once every plurality of numbers of times for the ion current modulation. It is, of course, possible to carry out the adjustment step at first followed by the ion current modulation, thereafter alternating both steps. However, when the adjustment step is to be performed by the use of the corona discharger for the modultion, the modulation during the adjustment step is not possible. When a separate unit of corona discharger diffeent from that for the modulation step is provided, it becomes possible to perform the adjustment and modulation steps in parallel, which contributes to quicken the speed for the retention copying.

When the characteristics of the screen used is such that potential difference is caused between the secondary electrostatic latent image produced from the initial modulation and that formed from the second and subsequent modulations, the application of the abovementioned two methods becomes necessary, i.e., the first is to increase the ion current for modulation only for the first stage, and the second is to apply another ion current different from the modulating ion current to the screen only at the initial stage of the preliminary step to be performed as a part of the secondary electrostatic latent image forming process. By carrying out the adjustment step at appropriate time during the modulation, it is possible to form the secondary electrostatic latent image with a constant potential. Although the various process steps starting from the preliminary step onward, as mentioned in the foregoing, may, of course, be required depending on the screen conditions, the adjustment step is indispensable in the repeated ion current moduation, wherein the corona ions are applied to the one and the same primary electrostatic latent image at every time and over a plurality of numbers of times. The photosensitive screen and lattice applicable to the present invention is not limited to those shown in the afore-described actual examples alone, but it is particularly effective to the structure, wherein a plurality of numbers of times for the modulation through one and the same primary electrostatic latent image is possible, and wherein the modulating corona ions adhere onto the screen during the modulation step repeated over a number of times. In the image forming technique using the photosensitive screen as in the present invention, since it is possible to form the image directly on the recording member by the use of the method of collecting the developing agent by the ion current, without forming the secondary electrostatic latent image with the modulated ion current, such secondary electrostatic latent image is not necessarily formed.

The electrophotographic method and apparatus of the present invention have thus made it possible to carry out the ion current modulation in constantly stable state, when such ion current modulation is to be repeated over a number of times through one and the same primary electrostatic latent image. Also, the adjustment step of the present invention serves to remarkably increase the number of times for the ion current modulation, because such modulating ion current prevents the primary electrostatic latent image from being destroyed during the modulation step. Furthermore, since the time-consuming operation of the primary electrostatic latent image formation by operating optical system and photo-reaction of the photoconductive member constituting the screen becomes unnecessary, high speed image formation is made possible.

Although the present invention has been described in greater detail hereinabove, it should be noted that these embodiments are merely illustrative of the present invention and not so restrictive, and that changes and modifications may be made by those skilled in the art within the purview of the present invention as set forth in the appended claims.

What is claimed is:

1. An electrophotographic method, wherein a photosensitive screen having a multitude of tiny openings therein is used, a primary latent image is formed on the screen, and an ion current is modulated by the screen image to form a second latent image on another surface, comprising steps of:

a. forming a primary electrostatic latent image by application of image light and an electrostatic charge to said screen in accordance with an original image to be reproduced;

b. repeatedly modulating a corona ion current with said primary latent image on said screen to form a plurality of secondary latent images using the same primary electrostatic latent image formed on said screen; and c. applying an adjusting corona ion flow to said screen, wherein said adjusting corona ion flow has a polarity and a direction to eliminate charges applied to said primary latent image during said repeated modulating steps without deteriorating said primary latent image.

2. The electrophotographic method as claimed in claim 1, further comprising a preliminary step of successively applying to said screen a corona ion current of the same polarity as that of said modulating corona ion current in advance of the corona ion current modulation.

3. The electrophotographic method as claimed in claim 1, wherein, when said repeated corona ion current modulation is carried out through said one primary electrostatic latent image, at least the initial corona ion current modulation is carried out with an intensified current as compared to a subsequent application of said modulation current.

4. An electrophotographic method, wherein a photosensitive screen provided therein with a number of tiny openings is utilized, a primary latent image is formed on the screen, and ion current is modulated by the screen image to form a secondary latent image on another surface, comprising steps of:

a. forming a primary electrostatic latent image by application of image light and an electrostatic charge to the screen in accordance with an original image to be reproduced, said photosensitive screen being capable retaining the primary image during modulation of ion current for a plurality of times by means of the same primary electrostatic latent image, wherein modulating efficiency is reduced by adherence of electric charge due to the application of modulating corona ions to the side of said screen at the time of the ion current modulation;

b. repeatedly modulating a corona ion current with said primary latent image on said screen to form a plurality of secondary latent images using the same primary electrostatic latent image formed on said photosensitive screen; and c. applying an adjusting corona ion flow to said screen, wherein said adjusting corona ion flow has a polarity and a direction to eliminate charges applied to said primary latent image during said repeated modulating steps without deteriorating said primary latent image.

5. The electrophotographic method as claimed in claim 4, wherein the adjusting corona ion flow is applied using a d.c. corona discharge of an opposite polarity to that of the modulating corona ion current.

6. The electrophotographic method as claimed in claim 4, wherein the adjusting corona ion flow is applied using an a.c. corona discharge.

7. The electrophotographic method as claimed in claim 4, wherein said step of applying an adjusting corona ion flow is carried out at least once for every formation of a said plurality of secondary images.

8. The electrophotographic method as claimed in claim 4, wherein said step of applying an adjusting corona ion flow is carried out once for every formation fo a said secondary image.

9. An electrophotographic apparatus for use in forming an image by modulating ion current through a photosensitive screen having a multitude of tiny openings therein, comprising, in combination:

a. means for forming a primary electrostatic latent image on said photosensitive screen, including means for applying image light and a first corona charge to said screen;

b. a corona discharger for repeatedly applying a corona ion current to the screen wherein said corona ion current is modulated by the same primary electrostatic latent image formed on said screen to form a plurality of secondary latent images on another surface; and c. means having a corona discharger for applying an adjusting corona ion current of a polarity to eliminate charges which adhere to said screen due to said modulating corona ion current without eliminating said primary electrostatic latent image.

10. The electrophotographic apparatus as claimed in claim 9, further comprising electrode means disposed on an opposite side of said screen from said adjusting corona discharger.

11. The electrophotographic apparatus as claimed in claim 9, wherein said screen comprises a three-layer structure having an electrically conductive substrate, a photoconductive member covering the conductive substrate, and a surface insulating member covering the photoconductive member.

12. The electrophotographic apparatus as claimed in claim 9, wherein said screen comprises a rotatable drum having said primary latent image forming means, said adjusting corona discharger, and said corona discharger for modulation disposed around said drum in the order as mentioned with respect to the direction of rotation of said drum.

13. An electrophotographic apparatus for use in forming an image by modulating ion current through a photosensitive screen having a multitude of openings therein, and comprising a rotatable drum having an electrically conductive member, a photoconductive member to cover said electrically conductive member, and an insulating member on said photoconductive member;

means for forming a primary electrostatic latent image including corona discharge means and optical means for image irradiation, both of which are provided in close proximity to the outer peripheral surface of said drum-shaped screen;

means disposed within said drum-shaped screen for applying a first corona ion flow repeatedly to said screen wherein said corona ion flow is modulated by the same primary electrostatic latent image on said screen to form a plurality of secondary latent images, and for applying a second corona ion flow to said screen for adjustment to eliminate electric charge adhered onto the screen by the corona ion flow for modulation.

14. The electrophotographic apparatus claimed in claim 13, wherein said means for applying said first and second ion flows comprises a single corona discharger for both modulation and adjustment.

15. The electrophotographic apparatus as claimed in claim 13, wherein said means for applying said first and second corona ion flows comprise first and second corona dischargers, for modulation and for adjustment respectively, wherein said corona discharger for adjustment is fixed in front of said corona discharger for modulation, with respect to the direction of rotation of the screen.

16. The electrophotographic apparatus as claimed in claim 13, wherein the photoconductive member and the insulating member of said screen are so constructed that the electrically conductive member may be exposed, and that the side where the conductive member is exposed may be made the inside of the drum.

* * * * *

UNITED STATES PATENT AND TRADEMARK OFFICE

CERTIFICATE OF CORRECTION

PATENT NO. : 4,046,466

DATED : September 6, 1977

INVENTOR(S) : YUJIRO ANDO, KATSUNOBU OHARA, YUKIMASA SHINOHARA

It is certified that error appears in the above-identified patent and that said Letters Patent are hereby corrected as shown below:

Column 1, line 12, delete "produced" and insert --reproduced--;

line 35, delete "can be" (first occurrence).

Column 2, line 33, change "imitial" to read --initial--;

line 34, after "produce" insert --favorable--;

line 35, change "latentimage" to read --latent image--;

line 36, change "contrastlowered" to read --contrast lowered--;

line 44, change "diffeence" to read --difference--.

Column 3, line 16, change "whn" to read --when--;

line 19, delete "change" and insert --charge--;

line 22, change "numbe" to read --number--;

line 42, delete "and" and insert --an--;

line 46, change "Fig." to read --Figs.--;

line 47, change "view" to read --views--.

Column 5, line 25, change "memeber" to read --member--;

line 42, change "thernoplastic" to read --thermoplastic--.

UNITED STATES PATENT AND TRADEMARK OFFICE

CERTIFICATE OF CORRECTION

PATENT NO. : 4,046,466
DATED : September 6, 1977
INVENTOR(S) : YUJIRO ANDO, KATSUNOBU OHARA, YUKIMASA SHINOHARA It is certified that error appears in the above-identified patent and that said Letters Patent are hereby corrected as shown below:

Column 6, line 59, delete "polarity" (first occurrence).

Column 7, line 8, delete "chage" and insert --charge--;

line 26, after "conductive" insert --member--;

line 58, after "an" insert --AC--.

Column 8, line 22, change "althrough" to read --although--.

Column 10, line 35, delete "while" and insert --which--.

Column 14, line 24, after "modulating" insert --ion--.

Column 16, line 25, delete "moes" and insert --moves--;

lines 40-41, change "numberal" to read numeral--

Column 18, line 5, delete "and" and insert --an--;

line 54, change "sight" to read --slight--.

UNITED STATES PATENT AND TRADEMARK OFFICE

CERTIFICATE OF CORRECTION

PATENT NO. : 4,046,466

DATED : September 6, 1977

INVENTOR(S) : YUJIRO ANDO, LATSUNOBU OHARA, YUKIMASA SHINOHARA

It is certified that error appears in the above-identified patent and that said Letters Patent are hereby corrected as shown below:

Column 19, line 51, change "diffeent" to read --different--.

Column 21, line 55, change "fo" to read --of--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*